US011493301B1

(12) United States Patent
Brush et al.

(10) Patent No.: US 11,493,301 B1
(45) Date of Patent: Nov. 8, 2022

(54) EXPLOSIVE DISRUPTION SYSTEM

(71) Applicant: Point One USA, LLC, Virginia Beach, VA (US)

(72) Inventors: Robert E. Brush, Virginia Beach, VA (US); Cameron M. Hovenga, Virginia Beach, VA (US)

(73) Assignee: Point One USA, LLC, Virginia Beach, VA (US)

( * ) Notice: Subject to any disclaimer, the term of this patent is extended or adjusted under 35 U.S.C. 154(b) by 0 days.

(21) Appl. No.: 17/338,026

(22) Filed: Jun. 3, 2021

(51) Int. Cl.
*F41B 9/00* (2006.01)
*F42D 5/04* (2006.01)

(52) U.S. Cl.
CPC ..... *F41B 9/0046* (2013.01); *F42D 5/04* (2013.01)

(58) Field of Classification Search
CPC .. F42B 33/062; F42B 3/00; F42B 3/22; F42B 33/06; F41B 9/0046; F41B 9/0043; F41B 9/00; F42D 5/04
See application file for complete search history.

(56) References Cited

U.S. PATENT DOCUMENTS 49,706 A * 9/1865 Boynton ..... F42B 3/00 102/315
415,899 A * 11/1889 Butterfield et al. ..... F42B 3/00 102/331
1,091,878 A * 3/1914 Cordray ..... F42B 3/00 102/331
2,385,810 A * 10/1945 Hopkins ..... F42B 3/00 86/20.12
3,190,219 A * 6/1965 Venghiattis ..... F42B 3/08 102/306
3,291,050 A * 12/1966 Ahlert ..... F42B 3/00 102/364
3,355,053 A * 11/1967 Sexton ..... F42B 3/02 220/521
3,517,616 A * 6/1970 Martin ..... B65D 1/0223 102/323
4,023,494 A * 5/1977 Barton ..... F42B 3/00 102/314
4,955,939 A 9/1990 Petrousky et al.
(Continued)

FOREIGN PATENT DOCUMENTS

EP 2443414 11/2016

*Primary Examiner* — Joshua E Freeman
(74) *Attorney, Agent, or Firm* — Shaddock Law Group, PC

(57) ABSTRACT

An explosive disruptor system including a disruptor container cavity; a disruptor tube having an initiating explosive chamber extending from a disruptor tube open end to a disruptor tube shoulder and a primary explosive chamber extending from the disruptor tube shoulder to a disruptor tube bottom wall, the primary explosive chamber having a reduced internal diameter when compared to an internal diameter of the initiating explosive chamber; a container cap having a aperture formed therethrough; and a strain relief connector having a body portion with external strain relief connector body threads, the body portion being at least partially insertable through the aperture such that at least a portion of the external strain relief connector body threads extend through the aperture, the external strain relief connector body threads formed so as to interact with internal disruptor tube threads to repeatably threadedly attached the strain relief connector to the disruptor tube.

20 Claims, 13 Drawing Sheets

(56) References Cited

U.S. PATENT DOCUMENTS

| | | | | |
|---|---|---|---|---|
| 5,763,816 | A * | 6/1998 | Keeling | C06C 7/00 102/275.12 |
| 6,363,828 | B1 * | 4/2002 | Sherlock | F42B 33/06 42/51 |
| 6,405,627 | B1 * | 6/2002 | Anderson | C06B 25/36 89/1.13 |
| 6,960,267 | B1 * | 11/2005 | Nixon, III | C06B 33/08 149/109.6 |
| 9,506,729 | B2 * | 11/2016 | Patel | C06B 25/36 |
| 11,262,155 | B2 * | 3/2022 | Vabnick | F42B 12/745 |
| 2005/0081706 | A1 * | 4/2005 | Alford | F42B 33/062 89/1.13 |
| 2012/0097015 | A1 * | 4/2012 | Alford | F41B 9/0046 86/50 |
| 2015/0241179 | A1 * | 8/2015 | Patel | F42B 3/10 89/1.13 |
| 2018/0259311 | A1 * | 9/2018 | Sasnett | F41A 23/02 |
| 2021/0404785 | A1 * | 12/2021 | Sasnett | F42D 5/04 |

* cited by examiner

EXPLOSIVE DISRUPTION SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of explosive devices and systems. More specifically, the present disclosure relates to an explosive disruptor system.

2. Description of Related Art

In the realm of improvised explosive devices and terrorist type scenarios military Explosive Ordnance Disposal ("EOD") and Public Safety Bomb Technician ("PSBT") specialists remotely access and disarm or neutralize hazardous devices with water tools, shot gun style disruptors, and robots when available.

Water systems using a high explosive to propel the water typically employ a high explosive to generate a shock wave through a liquid to provide pressure to do disruptive work. A bowl charge uses high explosives to drive water contained in the plastic bowl to disrupt an Improvised Explosive Device ("IED"). The shock pressures drive the water to do work but, depending on the bowl charge construction and design, the performance of the tool can vary and be inconsistent.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

Unfortunately, known tools and techniques have a number of shortcomings. For example, the size and shapes of these known disrupter devices vary and the available tools can be problematic. The shotgun style disruptors propel fluids that impacted a target with very high pressure in a relatively small circumference. Other disrupter tools have issues with reliably detonating the disruptor tool, speeds of the material impacted a hazardous device, volume and pressure of the water, and reliability of the tool container.

In order to overcome these and other shortcomings of known disrupter tools and systems, the explosive disruptor system of the present disclosure provides an explosive disruptor system that utilizes a purpose-built disruptor tube, plastic bottle or container, such as, for example, a Nalgene bottle, and a commercial fitting. This system is used for remotely accessing unknown or potential hazardous packages and/or devices. This system utilizes a purpose-built system of components consisting of both commercial off the shelf items and a purpose-built disruptor tube that can be filled with explosives and inserted into a Nalgene style bottle.

The explosive disruptor system utilizes explosively propelled water or other working liquid to violently open and disrupt potential hazardous packages and/or devices to gain access to the inside of the device safely and remotely. The disruptor tube's size correlates to the bottle size. The disruptor tube is packed with a primary explosive, such as, for example, C4 explosives, and then topped with discs of an initiating explosive, such as, for example, C2 sheet explosives. Properly packing the diameter of the open end portion of the disruptor tube with the initiating explosive (i.e., C2 the sheet explosives) ensures a consistent and reliable detonation of the primary explosive (i.e., the C4).

During use, the working liquid is propelled at a high rate of speed (i.e., between approximately 2,000 and 2,500 fps) with a density that is sufficient to open and disrupt a host of packages and materials. This explosive disruptor system of the present disclosure utilizes an explosive charge to create the energy required to propel the working liquid at the speed needed to disarm or neutralize hazardous devices without initiating the majority of sensitive secondary explosives.

In certain exemplary, nonlimiting embodiments, the explosive disruptor system of the present disclosure provides at least some of a disruptor container, wherein a disruptor container cavity is formed within a portion of the disruptor container and defined by one or more disruptor container side walls and a disruptor container bottom wall, wherein the disruptor container cavity extends from a disruptor container open end, along the one or more disruptor container side walls, to a disruptor container bottom wall, wherein external disruptor container threads are formed proximate the disruptor container open end; a disruptor tube, wherein the disruptor tube is formed of an integral portion of material, wherein a disruptor tube cavity is formed within a portion of the disruptor tube, wherein the disruptor tube cavity extends from a disruptor tube open end to a disruptor tube bottom wall and includes an initiating explosive chamber and a primary explosive chamber, wherein the initiating explosive chamber is defined by an initiating explosive chamber sidewall that extends from the disruptor tube open end, along the initiating explosive chamber sidewall, to a disruptor tube shoulder, wherein the initiating explosive chamber is defined by an initiating explosive chamber sidewall that extends from the disruptor tube open end, along the initiating explosive chamber sidewall, to a disruptor tube shoulder, wherein the primary explosive chamber is defined by a primary explosive chamber sidewall that extends from the disruptor tube shoulder, along the primary explosive chamber sidewall, to the disruptor tube bottom wall, wherein the primary explosive chamber has a reduced internal diameter when compared to an internal diameter of the initiating explosive chamber, wherein the disruptor tube shoulder defines a transition between the initiating explosive chamber and the primary explosive chamber, and wherein internal disruptor tube threads are formed in an interior surface of a portion of the disruptor tube cavity, extending from the disruptor tube open end; a container cap, wherein the container cap includes a container cap recess having container cap internal threads formed within at least a portion of the container cap recess, wherein the container cap internal threads are formed so as to interact with the external disruptor container threads such that the container cap can be repeatably threadedly attached to the disruptor container, and wherein a container cap aperture is formed through the container cap; and a strain relief connector, wherein the strain relief connector includes a strain relief connector body portion, a strain relief connector claw portion, and a strain relief connector borehole formed therethrough, wherein external strain relief connector body threads are formed within at least a portion of the strain relief connector body portion, wherein the strain relief connector body portion is formed so as to be at least partially insertable through the container cap aperture of the container cap such that at least a portion of the external strain relief connector body threads extend into the container cap recess, wherein the external strain relief connector body threads are formed so as to interact with the internal disruptor tube threads, so that the strain relief connector can be repeatably threadedly attached to the internal disruptor tube threads of the disruptor tube, wherein external connector nut threads are formed in the strain relief connector body portion, wherein the external connector nut threads are formed so as to interact with connector nut internal threads of a connector nut so that the connector nut can be threadedly attached to the strain relief connector such that interaction between the connector nut and the strain relief connector claw portion causes an inner diameter of the strain relief connector borehole, within the strain relief connector claw portion, to be reduced.

In certain exemplary, nonlimiting embodiments, the one or more disruptor container side walls are formed of a combination of wall portions.

In certain exemplary, nonlimiting embodiments, the one or more disruptor container side walls are formed of a single, continuous, integrally formed wall portion.

In certain exemplary, nonlimiting embodiments, the one or more disruptor container side walls and the disruptor container bottom wall are formed of a single, continuous, integrally formed wall portion.

In certain exemplary, nonlimiting embodiments, a longitudinal axis of the disruptor container extends generally from the disruptor container open end to the disruptor container bottom wall of the disruptor container.

In certain exemplary, nonlimiting embodiments, the disruptor container is formed of a substantially rigid, nonmetallic and/or nonconductive material.

In certain exemplary, nonlimiting embodiments, the disruptor container is formed of a polycarbonate, polyester, polysulfone, or polyester ketone material.

In certain exemplary, nonlimiting embodiments, the initiating explosive chamber sidewall, the disruptor tube shoulder, and the primary explosive chamber sidewall comprise a single, continuous, integrally formed wall portion.

In certain exemplary, nonlimiting embodiments, a size and shape of the primary explosive chamber is be formed such that a determined amount of a primary explosive material can be contained within the primary explosive chamber and a size and shape of the initiating explosive chamber is formed such that a determined amount of an initiating explosive material can be contained within the initiating explosive chamber.

In certain exemplary, nonlimiting embodiments, a longitudinal axis of the disruptor tube extends generally from the disruptor tube open end to the disruptor tube bottom wall.

In certain exemplary, nonlimiting embodiments, the disruptor tube is formed of a substantially rigid, nonmetallic and/or nonconductive, polymer material.

In certain exemplary, nonlimiting embodiments, the disruptor container is a 500 mL disruptor container, a length of the disruptor tube is approximately 154 mm, an outer diameter of the disruptor tube, within the initiating explosive chamber portion is approximately 20 mm, an outer diameter within the primary explosive chamber portion is approximately 13 mm, a length of the primary explosive chamber is approximately 117 mm, a length of the initiating explosive chamber is approximately 37 mm, an inner diameter of the primary explosive chamber is approximately 11 mm, an inner diameter of the initiating explosive chamber is approximately 14.25 mm, a thickness of the bottom wall is approximately 2 mm, and the thickness of the bottom wall is greater than a thickness of the primary explosive chamber sidewall.

In certain exemplary, nonlimiting embodiments, the disruptor container is a 1000 mL disruptor container, a length of the disruptor tube is approximately 177 mm, an outer diameter of the disruptor tube, within the initiating explosive chamber portion is approximately 22 mm, an outer diameter within the primary explosive chamber portion is approximately 19 mm, a length of the primary explosive chamber is approximately 140 mm, a length of the initiating explosive chamber is approximately 37 mm, an inner diameter of the primary explosive chamber is approximately 17 mm, an inner diameter of the initiating explosive chamber is approximately 14.25 mm, a thickness of the bottom wall is approximately 2 mm, and the thickness of the bottom wall is greater than a thickness of the primary explosive chamber sidewall.

In certain exemplary, nonlimiting embodiments, an appropriate amount of a primary explosive material is positionable within the primary explosive chamber such that the primary explosive material fills the primary explosive chamber from the disruptor tube bottom wall to the disruptor tube shoulder.

In certain exemplary, nonlimiting embodiments, an appropriate amount of an initiating explosive material is positionable within the initiating explosive chamber such that the initiating explosive material is abutted against at least a portion of the disruptor tube shoulder.

In certain exemplary, nonlimiting embodiments, a working fluid can be contained within the disruptor container cavity.

In certain exemplary, nonlimiting embodiments, the explosive disruptor system of the present disclosure provides at least some of a disruptor container having a disruptor container cavity formed within a portion of the disruptor container, the disruptor container cavity being defined by one or more disruptor container side walls and a disruptor container bottom wall and extending from a disruptor container open end to a disruptor container bottom wall and having external disruptor container threads formed proximate the disruptor container open end; a disruptor tube formed of an integral portion of material and having a disruptor tube cavity formed within a portion of the disruptor tube, extending from a disruptor tube open end to a disruptor tube bottom wall, and including an initiating explosive chamber and a primary explosive chamber, the initiating explosive chamber being defined by an initiating explosive chamber sidewall extending from the disruptor tube open end to a disruptor tube shoulder, the primary explosive chamber being defined by a primary explosive chamber sidewall extending from the disruptor tube shoulder to the disruptor tube bottom wall, the primary explosive chamber having a reduced internal diameter when compared to an internal diameter of the initiating explosive chamber, the disruptor tube shoulder defining a transition between the initiating explosive chamber and the primary explosive chamber, and internal disruptor tube threads formed in an interior surface of a portion of the disruptor tube cavity, extending from the disruptor tube open end; a container cap having a container cap recess and container cap internal threads formed within at least a portion of the container cap recess, the container cap internal threads formed so as to interact with the external disruptor container threads such that the container cap can be repeatably threadedly attached to the disruptor container, and a container cap aperture formed through the container cap; and a strain relief connector having a strain relief connector body portion, a strain relief connector claw portion, and a strain relief connector borehole formed therethrough, external strain relief connector body threads being formed within at least a portion of the strain relief connector body portion, the strain relief connector body portion formed so as to be at least partially insertable through the container cap aperture of the container cap such that at least a portion of the external strain relief connector body threads extend into the container cap recess, the external strain relief connector body threads formed so as to interact with the internal disruptor tube threads, so that the strain relief connector can be repeatably threadedly attached to the internal disruptor tube threads of the disruptor tube, external connector nut threads formed in the strain relief connector body portion being formed so as to interact with connector nut internal threads of a connector nut so that the connector nut can be threadedly attached to the strain relief connector.

In certain exemplary, nonlimiting embodiments, the one or more disruptor container side walls are formed of a single, continuous, integrally formed wall portion.

In certain exemplary, nonlimiting embodiments, the initiating explosive chamber sidewall, the disruptor tube shoulder, and the primary explosive chamber sidewall comprise a single, continuous, integrally formed wall portion.

In certain exemplary, nonlimiting embodiments, the explosive disruptor system of the present disclosure provides at least some of a disruptor container having a disruptor container cavity formed within a portion of the disruptor container, the disruptor container cavity having one or more disruptor container side walls and a disruptor container bottom wall and extending from a disruptor container open end to a disruptor container bottom wall and having external disruptor container threads formed proximate the disruptor container open end; a disruptor tube formed of an integral portion of material and extending from a disruptor tube open end to a disruptor tube bottom wall and including an initiating explosive chamber and a primary explosive chamber, the initiating explosive chamber being defined by an initiating explosive chamber sidewall extending from the disruptor tube open end to a disruptor tube shoulder, the primary explosive chamber being defined by a primary explosive chamber sidewall extending from the disruptor tube shoulder to the disruptor tube bottom wall, the primary explosive chamber having a reduced internal diameter when compared to an internal diameter of the initiating explosive chamber, the disruptor tube shoulder defining a transition between the initiating explosive chamber and the primary explosive chamber, and internal disruptor tube threads formed in an interior surface of a portion of the disruptor tube cavity, extending from the disruptor tube open end; a container cap having a container cap aperture formed through the container cap; and a strain relief connector having a strain relief connector body portion and a strain relief connector claw portion, external strain relief connector body threads being formed within at least a portion of the strain relief connector body portion, the strain relief connector body portion formed so as to be at least partially insertable through the container cap aperture of the container cap such that at least a portion of the external strain relief connector body threads extend through the container cap aperture, the external strain relief connector body threads formed so as to interact with the internal disruptor tube threads, so that the strain relief connector can be repeatably threadedly attached to the internal disruptor tube threads of the disruptor tube.

In certain exemplary, nonlimiting embodiments, the explosive disruptor system of the present disclosure provides at least some of a disruptor container having a disruptor container cavity; a disruptor tube having an initiating explosive chamber extending from a disruptor tube open end to a disruptor tube shoulder and a primary explosive chamber extending from the disruptor tube shoulder to a disruptor tube bottom wall, the primary explosive chamber having a reduced internal diameter when compared to an internal diameter of the initiating explosive chamber; a container cap having a aperture formed therethrough; and a strain relief connector having a body portion with external strain relief connector body threads, the body portion being at least partially insertable through the aperture such that at least a portion of the external strain relief connector body threads extend through the aperture, the external strain relief connector body threads formed so as to interact with internal disruptor tube threads to repeatably threadedly attached the strain relief connector to the disruptor tube.

Thus, the explosive disruptor systems and methods of the present disclosure provide a system for disrupting a hazardous device such as an improvised explosive device and/or a homemade bomb without detonating the hazardous device.

The explosive disruptor system provides the capability of propelling a volume of water in a disruptive manner and shape so that a sufficient amount of material (water) enters the target and breaks it apart. This is achieved by providing a volume of water containing disruptive energy, which is forced into the target with minimal solid material or non-metallic particles from the container. The explosive creates the effect of a wall of water, which confines the disruptive energy in a defined shape and directs the material into and through the target. Fragmentation is eliminated when the detonation disintegrates the housing for the explosive disruptor tube in the non-metallic bottle of working water during detonation.

Accordingly, the present disclosure separately and optionally provides an explosive disruptor system that is an improvement to hazardous device neutralization tools.

The present disclosure separately and optionally provides an explosive disruptor system that improves explosive disruptor system capabilities and can be utilized to remotely access and disarm or neutralize hazardous devices with the use of a working liquid such as, for example, water.

The present disclosure separately and optionally provides an explosive disruptor system that creates sufficient energy to propel the working liquid at an effective speed and velocity to disarm or neutralize hazardous devices without initiating the majority of sensitive secondary explosives.

The present disclosure separately and optionally provides an explosive disruptor system that provides an explosive disruptor water charge that, when detonated, will neutralize a hazardous device.

The present disclosure separately and optionally provides an explosive disruptor system with increased detonation reliability.

The present disclosure separately and optionally provides an explosive disruptor system that can be quickly and easily deployed.

The present disclosure separately and optionally provides a reliable and beneficial tool to help disable IEDs.

The present disclosure separately and optionally provides an explosive disruptor system that can be armed and deployed using a simplified explosive packing technique.

The present disclosure separately and optionally provides an explosive disruptor system that provides a standoff distance for deployment.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
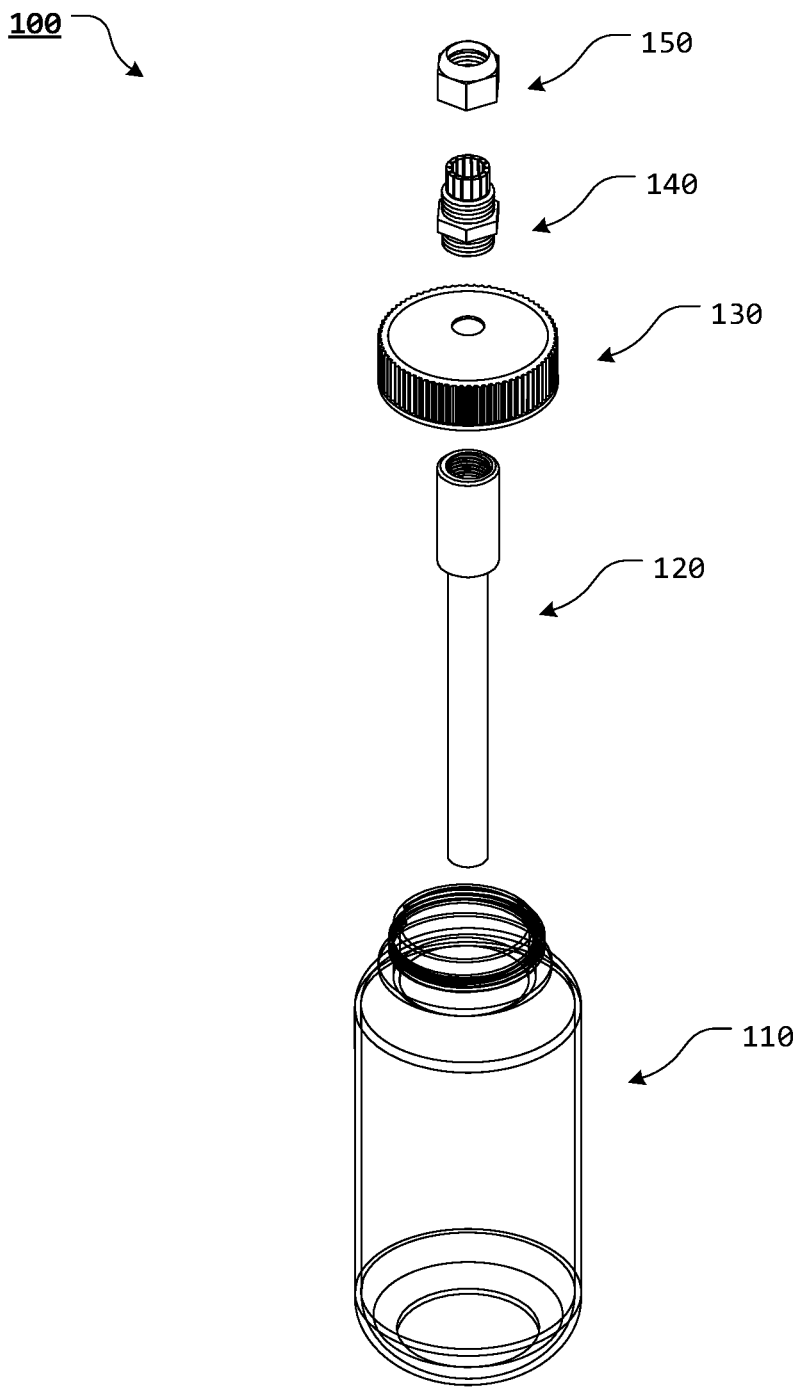
FIG. 1 illustrates an exploded, upper, perspective view of certain exemplary components of an exemplary embodiment of an explosive disruptor system assembly, according to the present disclosure.
Figure 2:
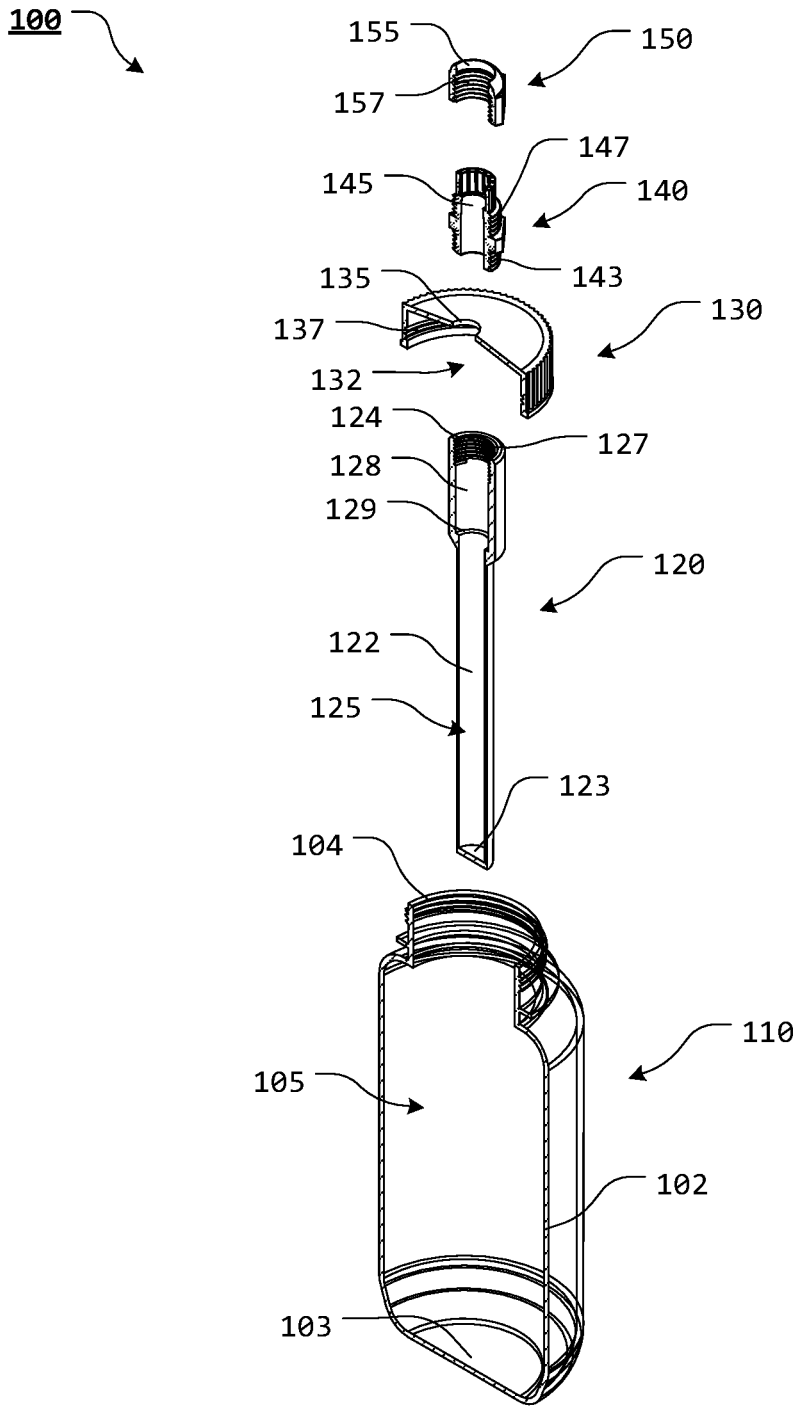
FIG. 2 illustrates an exploded, upper, perspective, cross-sectional view of certain exemplary components of an exemplary embodiment of an explosive disruptor system assembly, according to the present disclosure.
Figure 3:
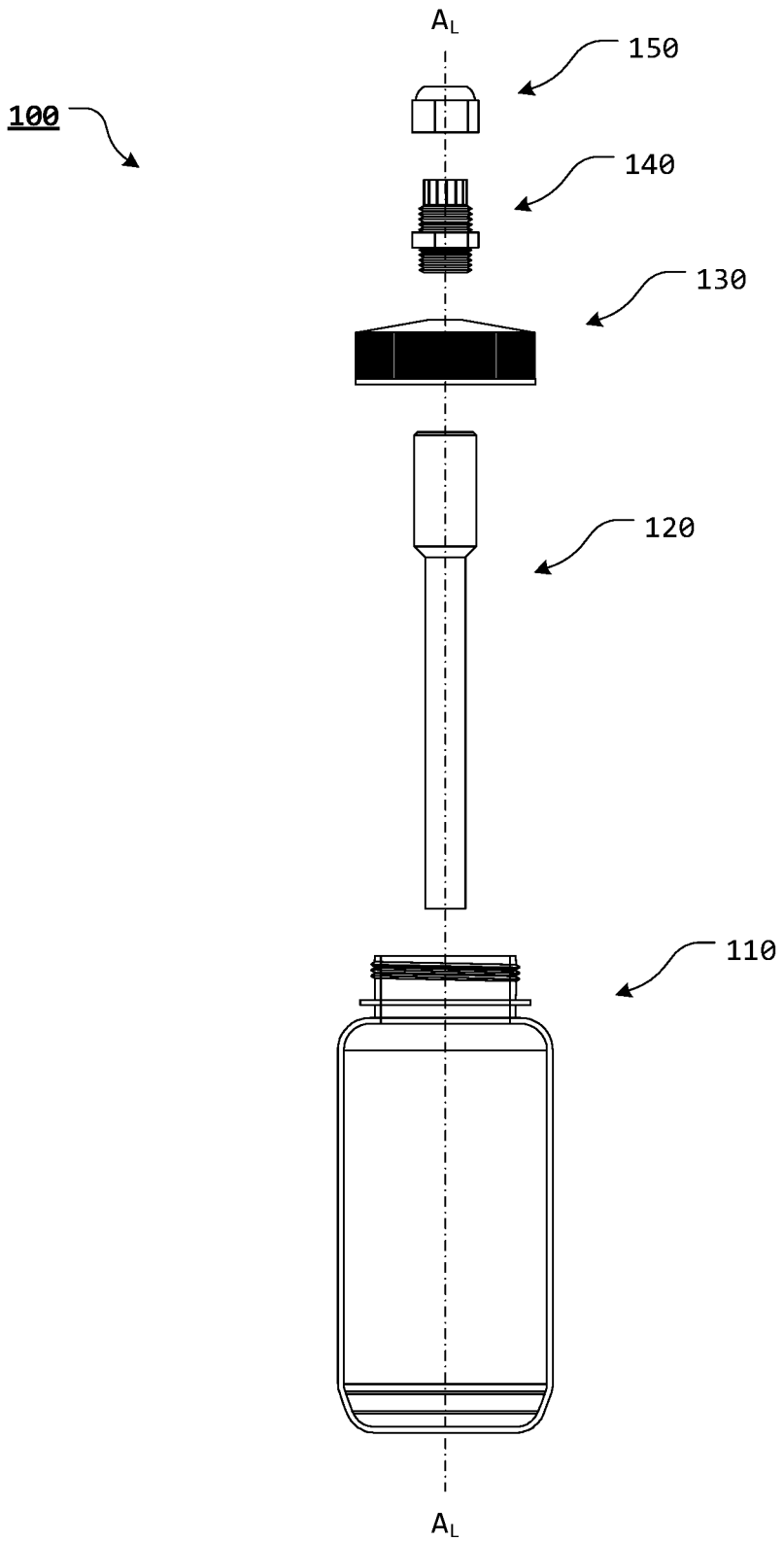
FIG. 3 illustrates an exploded, front view of certain exemplary components of an exemplary embodiment of an explosive disruptor system assembly, according to the present disclosure.
Figure 4:
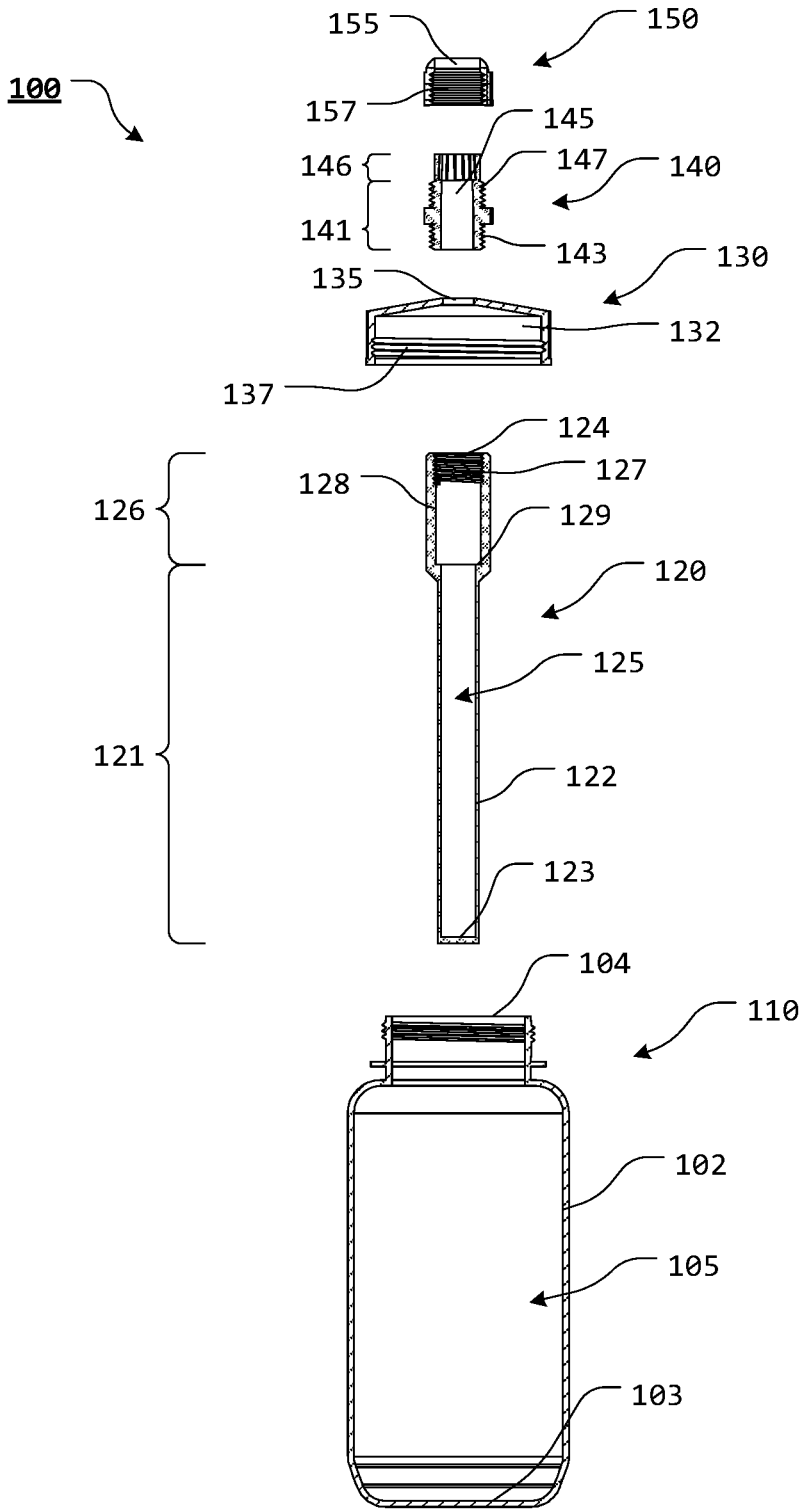
FIG. 4 illustrates an exploded, front, cross-sectional view of certain exemplary components of an exemplary embodiment of an explosive disruptor system assembly, according to the present disclosure.
Figure 5:
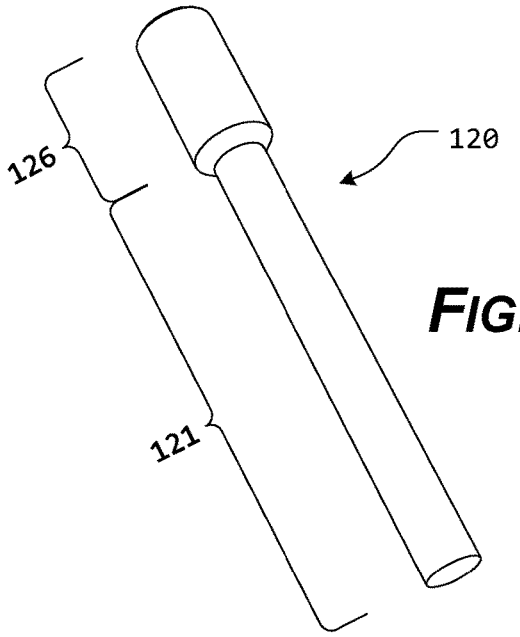
FIG. 5 illustrates a lower, perspective view of an exemplary embodiment of a disruptor tube of an explosive disruptor system assembly, according to the present disclosure.
Figure 6:
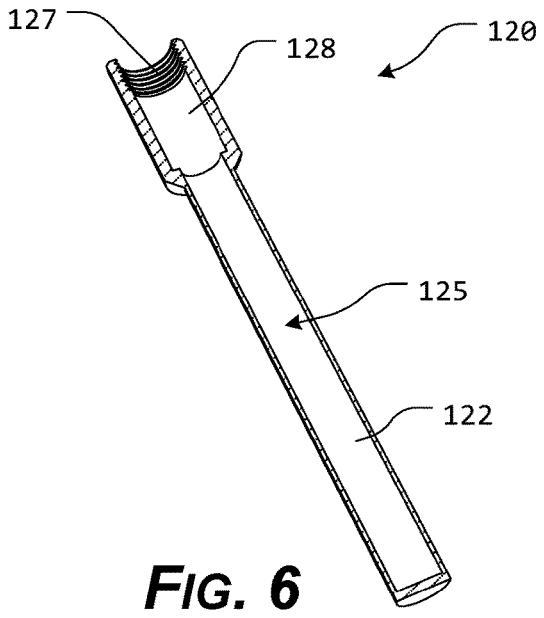
FIG. 6 illustrates a lower, perspective, cross-sectional view of an exemplary embodiment of a disruptor tube of an explosive disruptor system assembly, according to the present disclosure.
Figure 7:
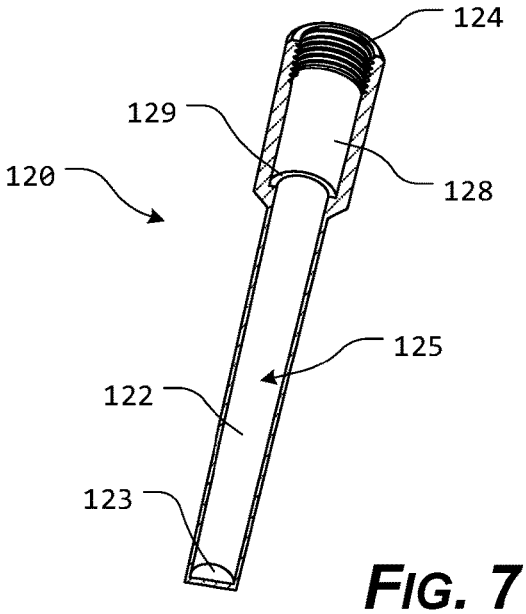
FIG. 7 illustrates an upper, perspective, cross-sectional view of an exemplary embodiment of a disruptor tube of an explosive disruptor system assembly, according to the present disclosure.

For simplicity and clarification, the design factors and operating principles of the explosive disruptor system according to the present disclosure are explained with reference to various exemplary embodiments of an explosive disruptor system according to the present disclosure. The basic explanation of the design factors and operating principles of the explosive disruptor system is applicable for the understanding, design, and operation of the explosive disruptor system of the present disclosure. It should be appreciated that the explosive disruptor system can be adapted to many applications where an explosive disruptor system can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that, for simplicity and clarification, certain embodiments of the present disclosure may be described using terms such as "front", "back", "rear", "right", "left", "upper", "lower", "outer", and/or "inner". However, it should be understood that these terms are merely used to aid in understanding of the present disclosure are not to be construed as limiting the systems, methods, devices, and/or apparatuses of the present disclosure. Additionally, it should be appreciated that, unless otherwise stated, the design factors and operating principles of the presently disclosed explosive disruptor system may optionally be used in a "mirror image" assembly, wherein elements shown and/or described as being included in or on an upper or identified side portion may optionally be included in or on a lower or other side portion. Alternatively, certain of the elements that are shown and/or described as being included in or on a back portion may optionally be included in or on a front portion, or vice versa.

It should also be appreciated that the terms "explosive disruptor system" and "disruptor" are used for basic explanation and understanding of the operation of the systems, methods, and apparatuses of the present disclosure. Therefore, the terms "explosive disruptor system" and "disruptor" are not to be construed as limiting the systems, methods, and apparatuses of the present disclosure.

Furthermore, it should be appreciated that, for simplicity and clarification, the embodiments of the present disclosure will be shown and/or described with reference to the explosive disruptor system being utilized in connection with an exemplary disruptor container. However, it should be appreciated that the explosive disruptor system of the present disclosure may be utilized in connection various containers or bottles.

Turning now to the appended drawing figures, FIGS. 1-20 illustrate certain elements, components, and/or aspects of certain exemplary embodiments of an explosive disruptor system or explosive disruptor system assembly 100, according to the present disclosure.

As illustrated most clearly in FIGS. 1-4, the explosive disruptor system assembly comprises at least some of a disruptor container 110, a disruptor tube 120, a container cap 130, a strain relief connector 140, and a connector nut 150.

In various exemplary embodiments, the disruptor container 110 includes an exterior surface and an interior surface. The interior surface of the disruptor container 110 forms a disruptor container cavity 115 defined by one or more disruptor container side walls 112 and a disruptor container bottom wall 113. The disruptor container cavity 115 extends from a disruptor container open end 114, along the one or more disruptor container side walls 112, to the disruptor container bottom wall 113. The disruptor container open end 114 provides access to the disruptor container cavity 115.

The one or more disruptor container side walls 112 may optionally be formed from any number or combination of wall portions, including, for example, a single, continuous wall portion or multiple coupled or joined wall portions. Thus, the disruptor container cavity 115 may optionally be formed by any cavity, partial cavity, or space that is capable of retaining the disruptor tube 120 and the working fluid 180.

In certain exemplary, nonlimiting embodiments, the disruptor container side walls 112 and the disruptor container bottom wall 113 comprise a single, continuous, integrally formed wall portion.

A longitudinal axis, $A_L$, extends generally from the disruptor container open end 114 to the disruptor container bottom wall 113 of the disruptor container 110.

In various exemplary embodiments, the disruptor container 110 is formed of a substantially rigid, nonmetallic and/or nonconductive, polymer material, such as, for example, a polycarbonate plastic (such as a polycarbonate, made from bisphenol A (BPA) and phosgene ($COCl_2$)), polyester, polysulfone, or polyester ketone.

External disruptor container threads 117 are formed in the exterior surface of a portion of the disruption container 110, extending from the disruptor container open end 114. The external threading of the external disruptor container threads 117 is formed so as to allow interaction between the external disruptor container threads 117 and the container cap internal threads 137, formed within the cap recess 132 of the container cap 130, such that the container cap 130 can be repeatably threadedly attached or removed from the external disruptor container threads 117 of the disruptor container 110.

In various exemplary embodiments, the disruptor tube 120 is formed of an integral portion of material or unit and includes an exterior surface and an interior surface. Alternatively, suitable materials can be used and sections or elements made independently and attached or coupled together, such as by adhesives, welding, screws, rivets, pins, or other fasteners, to form the various elements of the disruptor tube 120.

The disruptor tube 120 includes an exterior surface and an interior surface. The interior surface of the disruptor tube 120 forms a disruptor tube cavity 125. The disruptor tube cavity 125 includes an initiating explosive chamber 126 and a primary explosive chamber 121.

The initiating explosive chamber 126 is defined by an initiating explosive chamber sidewall 128 and extends from the disruptor tube open end 124, along the initiating explosive chamber sidewall 128, to the disruptor tube shoulder 129. The disruptor tube open end 124 provides access to the initiating explosive chamber 126 and the primary explosive chamber 121.

The initiating explosive chamber sidewall 128 may optionally be formed from any number or combination of sidewalls or wall portions, including, for example, a single, continuous wall portion or multiple coupled or joined wall portions. In certain exemplary, nonlimiting embodiments, the initiating explosive chamber sidewall 128 and the disruptor tube shoulder 129 comprise a single, continuous, integrally formed wall portion.

The primary explosive chamber 121 is defined by a primary explosive chamber sidewall 122 and extends from the disruptor tube shoulder 129, along the primary explosive chamber sidewall 122, to the disruptor tube bottom wall 123. The portion of the primary explosive chamber 121 proximate the disruptor tube shoulder 129 provides access to the primary explosive chamber 121.

The primary explosive chamber sidewall 122 may optionally be formed from any number or combination of sidewalls or wall portions, including, for example, a single, continuous wall portion or multiple coupled or joined wall portions. In certain exemplary, nonlimiting embodiments, the primary explosive chamber sidewall 122 and the disruptor tube bottom wall 123 comprise a single, continuous, integrally formed wall portion.

A longitudinal axis, $A_L$, extends generally from the disruptor tube open end 124 to the disruptor tube bottom wall 123 of the disruptor tube 120.

The disruptor tube shoulder 129 is formed between the initiating explosive chamber 126 and the primary explosive chamber 121 and defines a transition between the initiating explosive chamber 126 and the primary explosive chamber 121. The disruptor tube shoulder 129 extends into at least a portion of the disruptor tube cavity 125, such that the primary explosive chamber 121 has a reduced internal diameter when compared to an internal diameter of the initiating explosive chamber 126. It should be appreciated that the length and internal diameter of each of the primary explosive chamber 121 and the initiating explosive chamber 126 is a design choice, based upon the desired amount of primary explosive material 170 and initiating explosive material 175, respectively, are to be utilized with the specific embodiments of the explosive disruptor system assembly 100.

It should also be appreciated that the size and shape of the primary explosive chamber 121 may be formed such that a specific amount of primary explosive material 170 can be contained within the primary explosive chamber 121 and the size and shape of the initiating explosive chamber 126 may be formed such that a specific amount of initiating explosive material 175 can be contained within the initiating explosive chamber 126. Thus, during use, a user does not need to measure the amounts of primary explosive material 170 and initiating explosive material 175 to be used, but may merely fill the primary explosive chamber 121 with a primary explosive material 170 and then fill the initiating explosive chamber 126 with an initiating explosive material 175.

Figure 19:
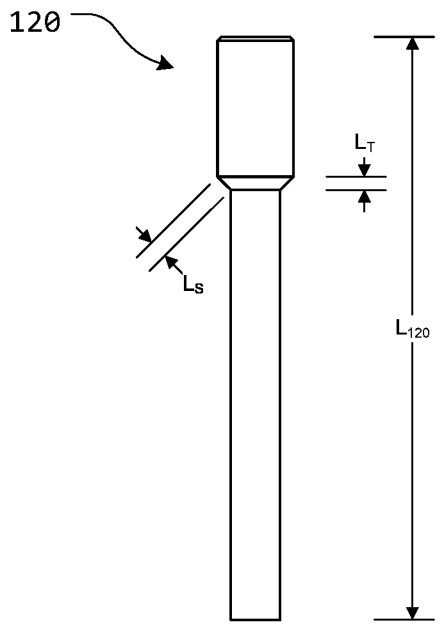
FIG. 19 illustrates a front view of an exemplary embodiment of a disruptor tube of an explosive disruptor system assembly, according to the present disclosure.
Figure 20:
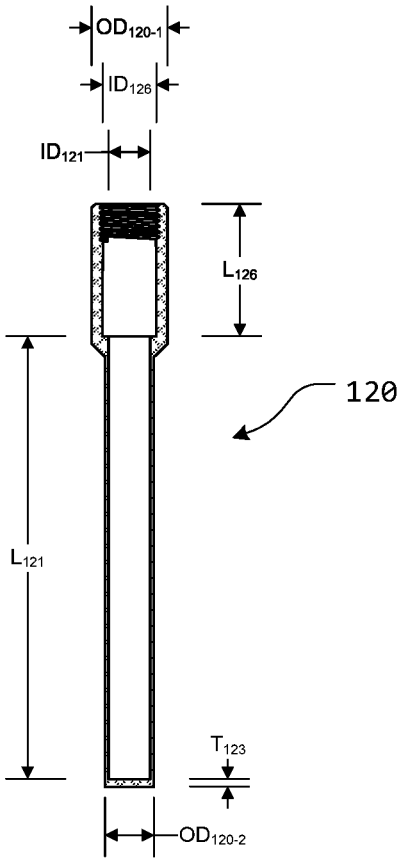
FIG. 20 illustrates a front, cross-sectional view of an exemplary embodiment of a disruptor tube of an explosive disruptor system assembly, according to the present disclosure.

In certain exemplary embodiments, as illustrated most clearly in FIGS. 19-20, the overall length $L_{120}$ of the disruptor tube 120 is approximately 154 mm. The outer diameter $OD_{120\text{-}1}$ of the disruptor tube 120, within the initiating explosive chamber 126 portion is approximately 20 mm, while the outer diameter $OD_{120\text{-}2}$, within the primary explosive chamber 121 portion is approximately 13 mm. The length $L_{121}$ of the primary explosive chamber 121 is approximately 117 mm, while the length $L_{126}$ of the initiating explosive chamber 126 is approximately 37 mm. The inner diameter $ID_{121}$ of the primary explosive chamber 121 is approximately 11 mm, while the inner diameter $ID_{126}$ of the initiating explosive chamber 126 is approximately 14.25 mm. Typically, the thickness $T_{123}$ of the bottom wall 123 is greater than the thickness of the primary explosive chamber sidewall 122. In certain exemplary embodiments, the thickness $T_{123}$ of the bottom wall 123 is approximately 2 mm. In certain exemplary embodiments, the length $L_T$ of an outer transition portion, along the longitudinal axis, $A_L$, between the primary explosive chamber 121 and the initiating explosive chamber 126 is approximately 3.5 mm, while a length Ls of a shoulder forming the outer transition portion between the primary explosive chamber 121 and the initiating explosive chamber 126 is approximately 4.95 mm.

In certain other exemplary embodiments, the overall length $L_{120}$ of the disruptor tube 120 is approximately 177 mm. The outer diameter $OD_{120\text{-}1}$ of the disruptor tube 120, within the initiating explosive chamber 126 portion is approximately 22 mm, while the outer diameter $OD_{120\text{-}2}$, within the primary explosive chamber 121 portion is approximately 19 mm. The length $L_{121}$ of the primary explosive chamber 121 is approximately 140 mm, while the length $L_{126}$ of the initiating explosive chamber 126 is approximately 37 mm. The inner diameter $ID_{121}$ of the primary explosive chamber 121 is approximately 17 mm, while the inner diameter $ID_{126}$ of the initiating explosive chamber 126 is approximately 14.25 mm. The thickness $T_{123}$ of the bottom wall 123 is approximately 2 mm. In certain exemplary embodiments, the length $L_T$ of an outer transition portion, along the longitudinal axis, $A_L$, between the primary explosive chamber 121 and the initiating explosive chamber 126 is approximately 1.5 mm, while a length Ls of a shoulder forming the outer transition portion between the primary explosive chamber 121 and the initiating explosive chamber 126 is approximately 2.12 mm.

While it should be appreciated that the various dimensions of the disruptor tube 120 is a design choice, the above dimensions are illustrative of a first exemplary embodiment of a disruptor tube 120 and a second exemplary embodiment of a disruptor tube 120. The first exemplary embodiment of the disruptor tube 120 (having a comparatively smaller primary explosive chamber 121) may optimally be utilized in conjunction with a 500 mL disruptor container 110, while the second exemplary embodiment of the disruptor tube 120 (having a comparatively larger primary explosive chamber 121) may optionally be utilized in conjunction with a 1000 mL disruptor container 110. By utilizing an appropriately sized disruptor tube 120 with a selected size disruptor container 110, the explosive disruptor system assembly 100 may work efficiently to prevent sensitive secondary explosives. It should also be appreciated that the disruptor tube 120 and the disruptor container 110 may optionally be used on small or large devices constructed of various materials, from cloth to certain metals.

The size of the primary explosive chamber 121 dictates the amount of C4 explosives to be used. The 11 mm primary explosive chamber 121 uses approximately 15 gr and the 17 mm primary explosive chamber 121 uses approximately 45 gr. The primary explosive chamber 121 is designed to be packed with explosives the length of the primary explosive chamber 121 and then discs of C2 sheet explosives are to be placed on top of the C4 at the base of the initiating explosive chamber 126 detonator well.

Internal disruptor tube threads 127 are formed in the interior surface of a portion of the disruptor tube cavity 125, extending from the disruptor tube open end 124. The internal threading of the internal disruptor tube threads 127 is formed so as to allow interaction between the internal disruptor tube threads 127 and the external body threads 143, formed within the connector body 141 of the strain relief connector 140, such that the strain relief connector 140 can be repeatably threadedly attached or removed from the internal disruptor tube threads 127 of the disruptor tube 120.

In various exemplary embodiments, the disruptor tube 120 is formed of a substantially rigid, nonmetallic and/or nonconductive, polymer material.

In various exemplary, nonlimiting embodiments, the container cap 130 includes a container cap recess 132 having container cap internal threads 137 formed so as to interact with the external disruptor container threads 107. Thus, interaction between the container cap internal threads 137 of the container cap 130 and the external disruptor container threads 107 allow the container cap 130 to be threadedly secured to the disruptor container 110.

A container cap aperture 135 is formed through the body of the container cap 130. The container cap aperture 135 is sized so as to allow at least a portion of the strain relief connector body 141 to be positioned therethrough, such that the external body threads 143 of the strain relief connector 140 extend through at least a portion of the connector cap aperture 135 and into the container cap recess 132.

By securing the container cap 132 the disruptor container 110, the disruptor tube 120 can be appropriately positioned within the disruptor container cavity 105 and the working fluid 180 can be secured within the disruptor container cavity 105.

The strain relief connector 140 includes a strain relief connector body portion 141 and a strain relief connector claw portion 146. A strain relief connector borehole 145 is formed through the strain relief connector 140.

External strain relief connector body threads 143 are formed within at least a portion of the strain relief connector body portion 141 and are formed so as to interact with the internal disruptor tube threads 127, so that the strain relief connector 140 can be threadedly attached to the disruptor tube open end 124 of the disruptor tube 120.

External connector nut threads 147 are also formed in the strain relief connector body portion 141. The external connector nut threads 147 are formed so as to extend away from the strain relief connector external body threads 143. The external connector nut threads 147 are formed so as to interact with connector nut internal threads 157 of a connector nut 150 so that the connector nut 150 can be threadedly attached to the strain relief connector 140.

When the connector nut 150 is threadedly attached to the strain relief connector 140, a connector nut borehole 155 of the connector nut 150 is aligned with the strain relief connector borehole 145. As the connector nut 150 is further secured to the strain relief connector 140, interaction between the connector nut 150 and the strain relief connector claw portion 146 causes an inner diameter of the strain relief connector borehole 145, within the strain relief connector claw portion 146, to be restricted or reduced, acting to further secure an item, such as, for example, a detonator element 190 within the strain relief connector borehole 145.

It should be appreciated that the disruptor container 110, the container cap 130, the strain relief connector 140, and the connector nut 150 may optionally be standard, off-the-shelf components, utilized to form the explosive disruptor system assembly 100. Thus, by providing a disruptor tube 120, various other components of the explosive disruptor system assembly 100 can be readily obtained.

FIGS. 8-18 most clearly illustrate the assembly and usage of the explosive disruptor system assembly 100. During assembly and use of the explosive disruptor system assembly 100, the disruptor tube 120 is initially presented and an appropriate primary explosive material 170 and initiating explosive material 175 are positioned within the primary explosive chamber 121 and the initiating explosive chamber 126.

Figure 8:
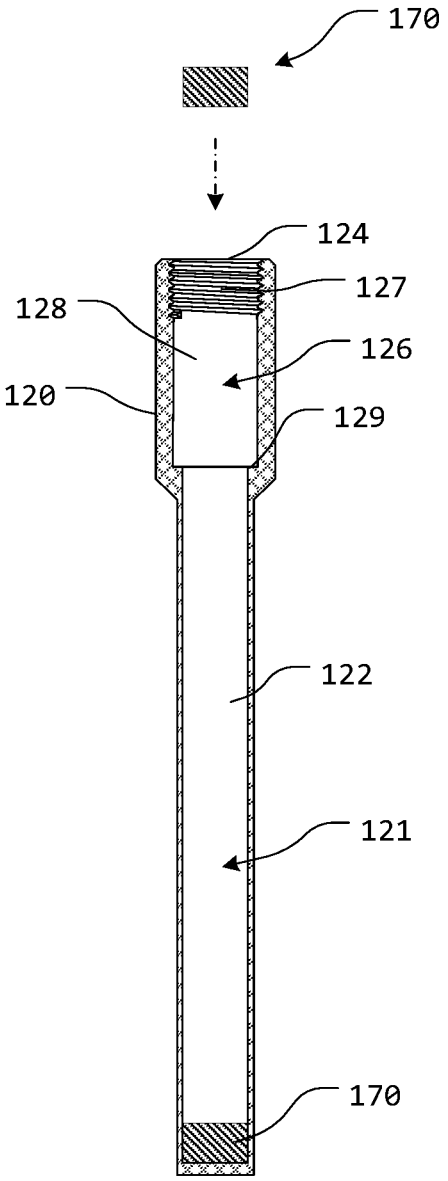
FIG. 8 illustrates a front, cross-sectional view of an exemplary embodiment of a disruptor tube and a primary explosive material of an explosive disruptor system assembly, according to the present disclosure.
Figure 9:
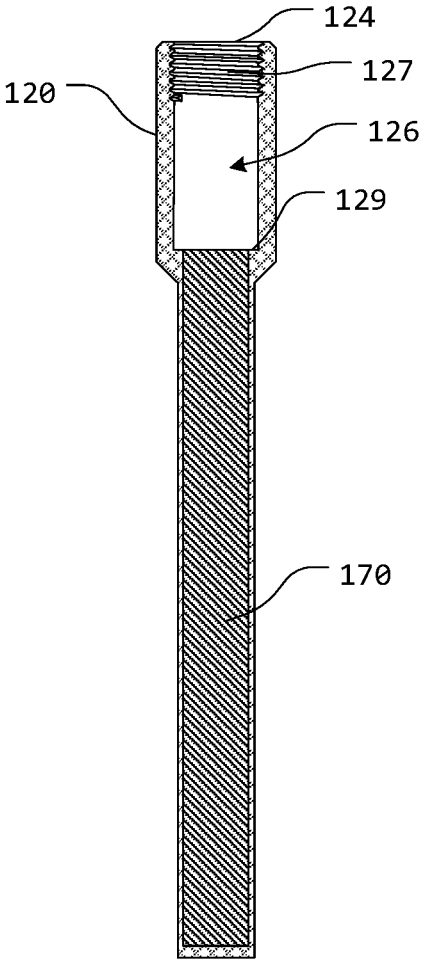
FIG. 9 illustrates a front, cross-sectional view of an exemplary embodiment of a disruptor tube and a primary explosive material of an explosive disruptor system assembly, according to the present disclosure.
Figure 10:
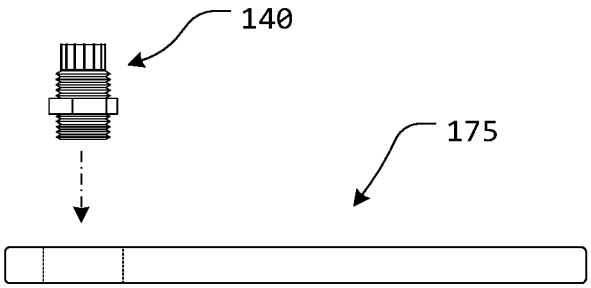
FIG. 10 illustrates a front view of an exemplary embodiment of an initiating explosive material to be utilized in conjunction with an explosive disruptor system assembly, according to the present disclosure.
Figure 11:
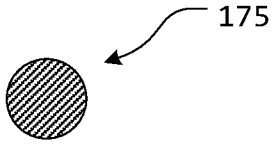
FIG. 11 illustrates a top view of an exemplary embodiment of an initiating explosive material to be utilized in conjunction with an explosive disruptor system assembly, according to the present disclosure.
Figure 12:
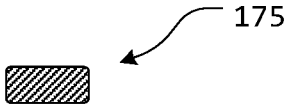
FIG. 12 illustrates a front view of an exemplary embodiment of an initiating explosive material to be utilized in conjunction with an explosive disruptor system assembly, according to the present disclosure.
Figure 13:
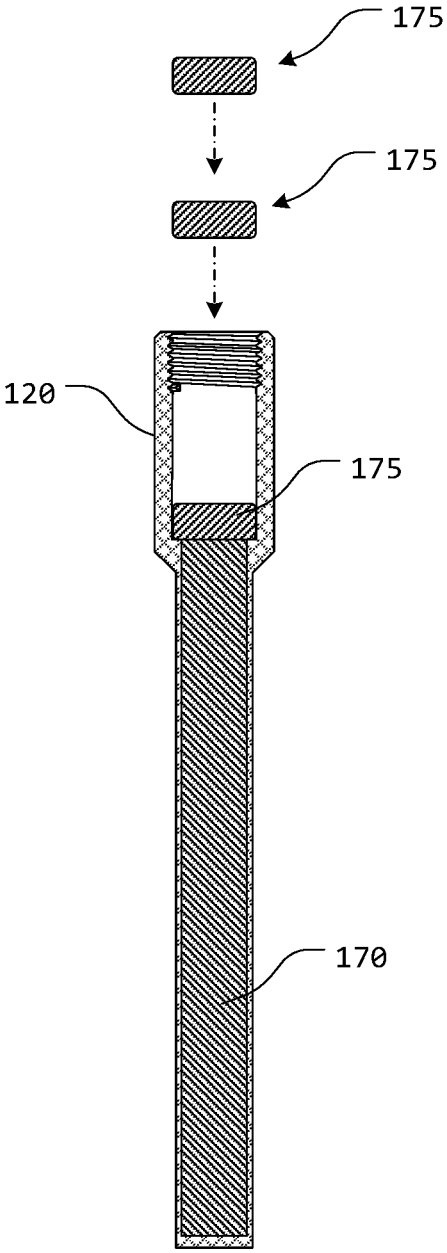
FIG. 13 illustrates a front, cross-sectional view of an exemplary embodiment of a disruptor tube, a primary explosive material, and an initiating explosive material of an explosive disruptor system assembly, according to the present disclosure.

As illustrated in FIG. 8, a primary explosive material 170 is positioned within the primary explosive chamber 121. In various exemplary embodiments, the primary explosive material 170 may comprise C4. In these exemplary embodiments, the primary explosive material 170 may be formed into appropriately sized balls or an elongate cylinder and positioned within the primary explosive chamber 121. The primary explosive material 170 is packed within the primary explosive chamber 121 until the primary explosive material 170 fills the primary explosive chamber 121 from the disruptor tube bottom wall 123 to the disruptor tube shoulder 129.

Next, an appropriate amount of the initiating explosive material 175 is positioned within the initiating explosive chamber 126. In certain exemplary embodiments, as illustrated in FIGS. 10-13, appropriate amounts of the initiating explosive material may be created by forming discs of the initiating explosive material 175. This may be accomplished by utilizing the base of the strain relief connector 140 to cut into an appropriate sheet of the initiating explosive material 175. By forming the discs of initiating explosive material 175 using the strain relief connector 140, the outer diameter of each disc will be appropriate to fit within the initiating explosive chamber 126.

Once formed, an appropriate number of discs of initiating explosive material 175 (i.e., three discs) are positioned within the initiating explosive chamber 126, adjacent the primary explosive material 170 and abutted against at least a portion of the disruptor tube shoulder 129.

Figure 14:
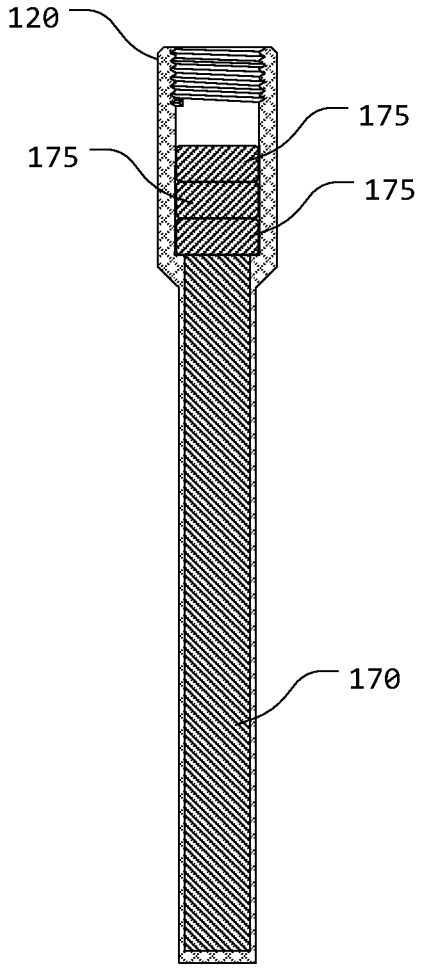
FIG. 14 illustrates a front, cross-sectional view of a partially assembled exemplary embodiment of a disruptor tube of an explosive disruptor system assembly, according to the present disclosure.

Once the primary explosive material 170 and the initiating explosive material 175 have been appropriately positioned within the primary explosive chamber 121 and the initiating explosive chamber 126, respectively, the disruptor tube 120 will appear as is illustrated in FIG. 14.

Figure 15:
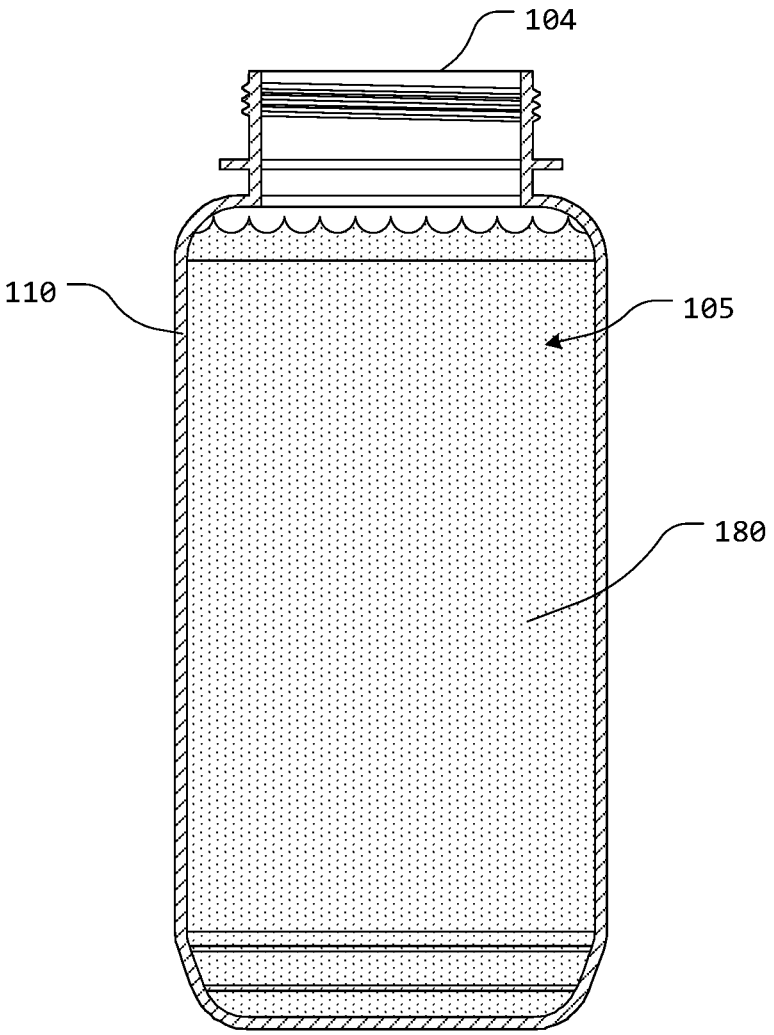
FIG. 15 illustrates a front, cross-sectional view of an exemplary embodiment of a disruptor container of an explosive disruptor system assembly, according to the present disclosure.

Next, as illustrated in FIG. 15, the working fluid 180 is positioned within the disruptor container cavity 105. Typically, the working fluid 180 is water.

Figure 16:
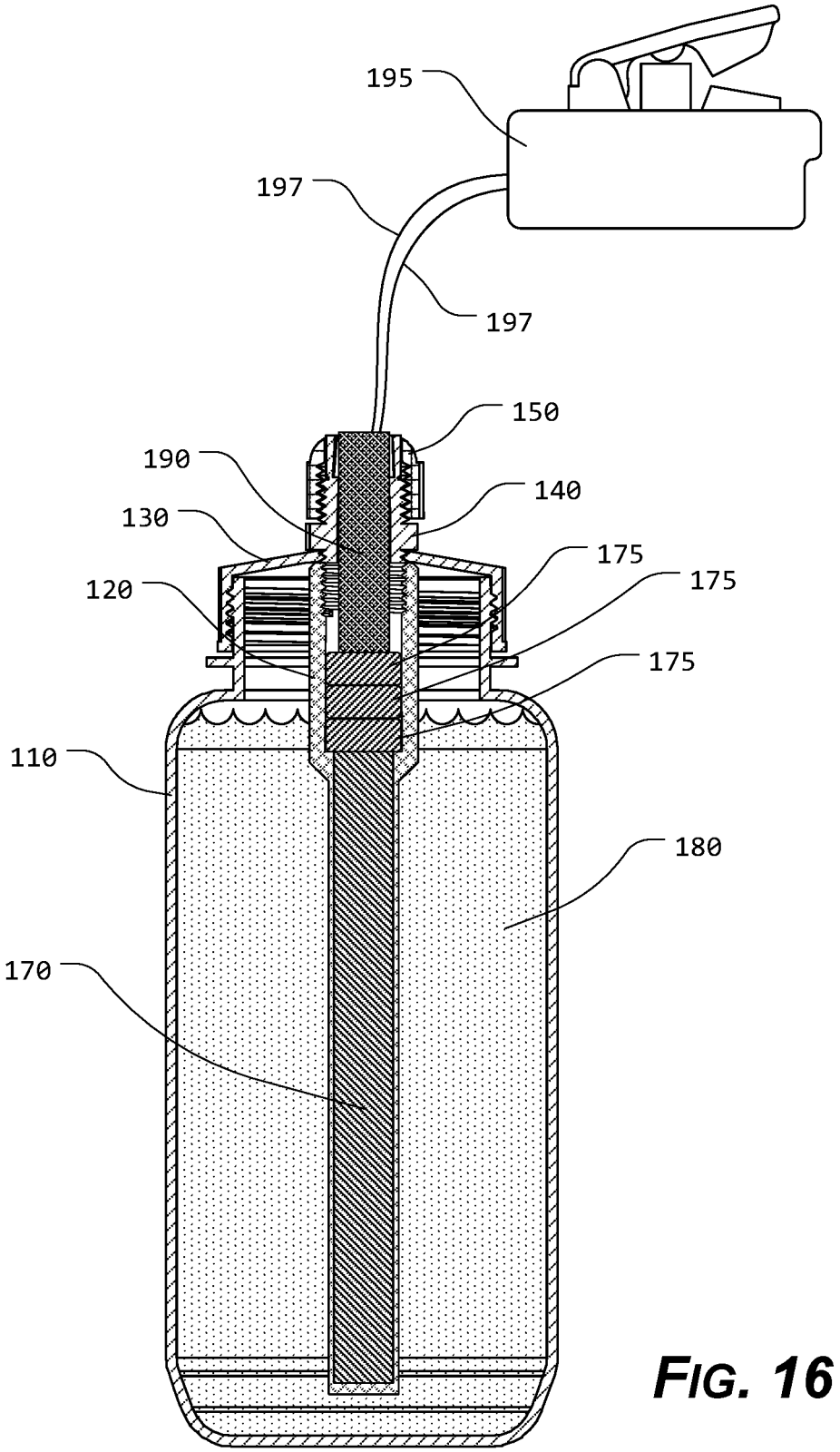
FIG. 16 illustrates a front, cross-sectional view of an exemplary embodiment of an assembled explosive disruptor system assembly, according to the present disclosure.
Figure 17:
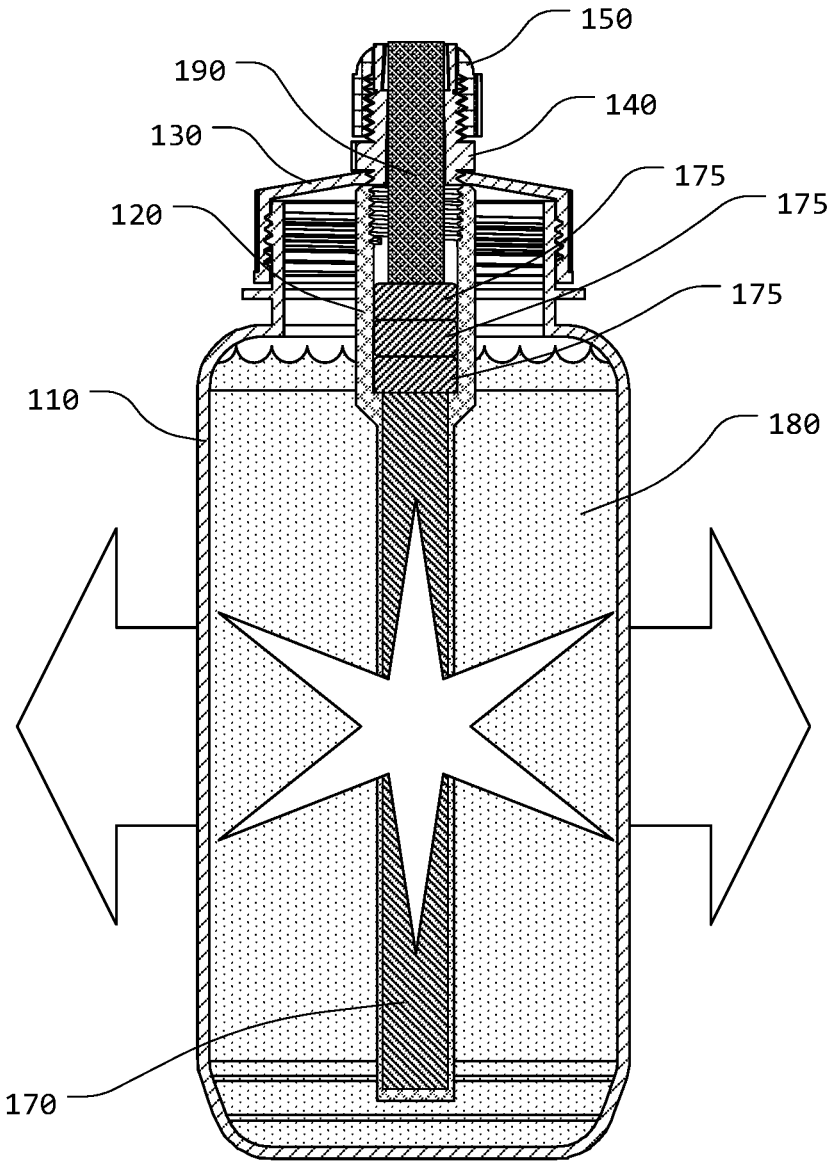
FIG. 17 illustrates a front, cross-sectional view of certain exemplary components of an exemplary embodiment of an assembled explosive disruptor system assembly, according to the present disclosure.
Figure 18:
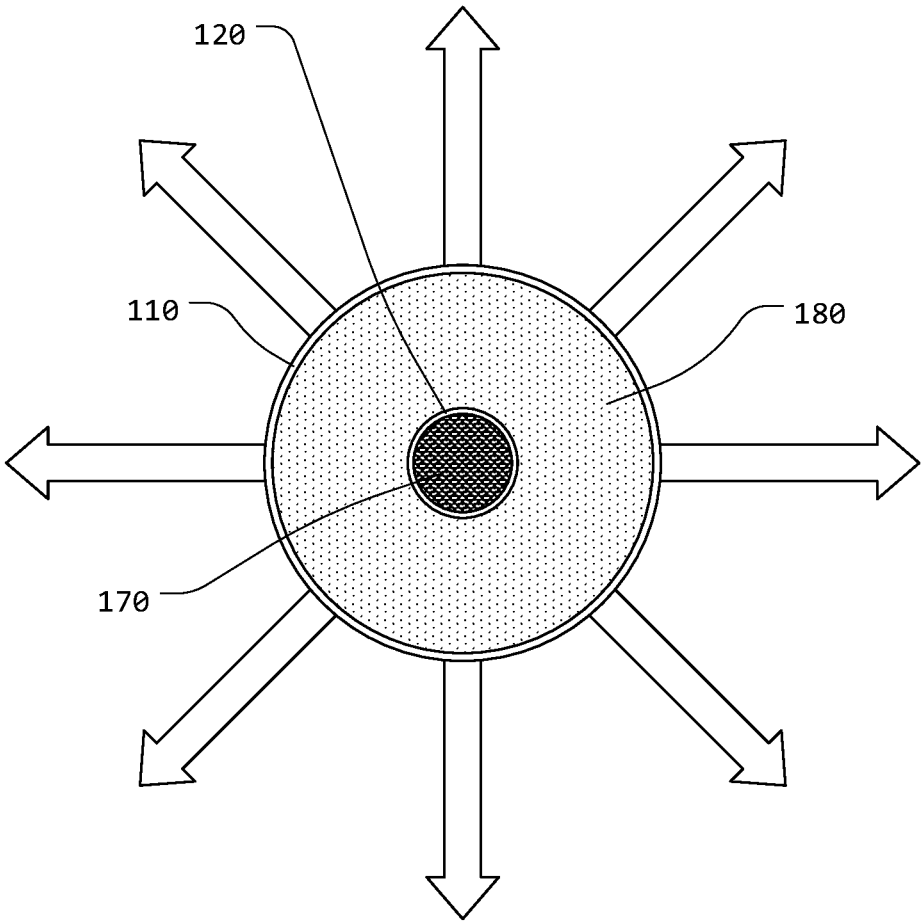
FIG. 18 illustrates a top, cross-sectional view of certain exemplary components of an exemplary embodiment of an assembled explosive disruptor system assembly, according to the present disclosure.

Then, as illustrated in FIG. 16, the strain relief connector body portion 141 is positioned through at least a portion of the container cap aperture 135 and the strain relief connector external body threads 143 interact with the disruptor tube internal threads 127 to secure the disruptor tube 120 to the container cap 130 and the strain relief connector 140. The connector nut 150 is initially threadedly attached or coupled to the strain relief connector external connector nut threads 147.

The container cap 130 is then threadedly attached or coupled to the disruptor container, via interaction of the container cap internal threads 137 and the external disruptor container threads 107. In this position, at least the primary explosive chamber 121 is positioned in the approximate center of the disruptor container cavity 105 (as viewed from a cross-sectional top view) within the working fluid 180.

The strain relief connector 140 is then used to seat and hold in place a detonator element 190 that is used to ignite or initiate explosion of the explosive disruptor system assembly 100. If the detonator element 190 comprises a blast cap, once the appropriately filled disruptor tube 120 is attached within the working fluid 180, as described herein, the explosive disruptor system assembly 100 is ready for use.

If the detonator element 190 comprises a detonation cord pigtail, a loop of detonation cord is filled with the initiating explosive material 175 (or some other appropriate explosive material) and the detonation cord is urged within the initiating explosive chamber 126 to contact the initiating explosive material 175 within the initiating explosive chamber 126 to ensure there is explosive continuity between the materials. If required for ignition of the detonator element 190, and initiating device 195 may be attached or coupled, via connecting elements 197, to the detonator element. The explosive disruptor system assembly 100 is then ready for use.

When configured, the disruptor tube 120, which contains the initiating explosive material 175 and the primary explosive material 170 performs the disruptor work of the explosive disruptor system assembly 100. The disruptor tube 120 is purposely enlarged on the top, where the strain relief connector 140 screws into to disruptor tube 120 the explosive charge that ignites the explosive disruptor system assembly 100. The width of the top of the disruptor tube 120 is formed so that initiating explosive material 175 in the form of sheet explosive can be inserted to ensure consistent ignition of the primary explosive material 170 in the primary explosive chamber 121.

Once ignited, explosion of the initiating explosive material 175 causes explosion of the primary explosion material 170. The arrows in FIGS. 17-18 help to illustrate the direction of travel of the working fluid 180 when the primary explosive material 170 is detonated. Because the explosive disruptor system assembly 100 is considered an omni directional tool, some energy will travel up and down, substantially parallel to the longitudinal axis, $A_L$, but the forceful working energy radiates horizontally, substantially perpendicular to the longitudinal axis, $A_L$, away from center of the disruptor container 110.

The speed and energy equates to between approximately 2,000-2,500 feet per second of water radiating out of the sides of the disruptor container 110. The working fluid 180 typically radiates between 4-8 inches from the side of the disruptor container 110.

By detonating the explosive disruptor system assembly 100 in appropriate proximity to a target package, the working fluid 180 is driven into the target package (i.e., a backpack, wood box, plastic bin, light metal toolbox, luggage, etc.) with sufficient energy to disrupt and open up the target package without sympathetically detonating explosives that may be contained within the target package.

Thus, although some of the working fluid 180 and energy are expelled from the top and bottom of the disruptor container 110, the majority of the working fluid 180 and energy radiate out from the disruptor container 110. This wall of working fluid 180 is what does the work and disrupts and target package. The explosive energy and working fluid 180 that enter the target package will tear apart the target package itself along with the contents and any circuitry that may be part of a target package.

A more detailed explanation of the instructions regarding how to utilize the explosive disruptor system assembly is not provided herein because it is believed that the level of description provided herein is sufficient to enable one of ordinary skill in the art to understand and practice the systems, methods, and apparatuses, as described.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An explosive disruptor system, comprising:

a disruptor container, wherein a disruptor container cavity is formed within a portion of said disruptor container and defined by one or more disruptor container side walls and a disruptor container bottom wall, wherein said disruptor container cavity extends from a disruptor container open end, along said one or more disruptor container side walls, to a disruptor container bottom wall, wherein external disruptor container threads are formed proximate said disruptor container open end;

a disruptor tube, wherein said disruptor tube is formed of an integral portion of material, wherein a disruptor tube cavity is formed within a portion of said disruptor tube, wherein said disruptor tube cavity extends from a disruptor tube open end to a disruptor tube bottom wall and includes an initiating explosive chamber and a primary explosive chamber, wherein said initiating explosive chamber is defined by an initiating explosive chamber sidewall that extends from said disruptor tube open end, along said initiating explosive chamber sidewall, to a disruptor tube shoulder, wherein said initiating explosive chamber is defined by an initiating explosive chamber sidewall that extends from said disruptor tube open end, along said initiating explosive chamber sidewall, to a disruptor tube shoulder, wherein said primary explosive chamber is defined by a primary explosive chamber sidewall that extends from said disruptor tube shoulder, along said primary explosive chamber sidewall, to said disruptor tube bottom wall, wherein said primary explosive chamber has a reduced internal diameter when compared to an internal diameter of said initiating explosive chamber, wherein said disruptor tube shoulder defines a transition between said initiating explosive chamber and said primary explosive chamber, and wherein internal disruptor tube threads are formed in an interior surface of a portion of said disruptor tube cavity, extending from said disruptor tube open end;

a container cap, wherein said container cap includes a container cap recess having container cap internal threads formed within at least a portion of said container cap recess, wherein said container cap internal threads are formed so as to interact with said external disruptor container threads such that said container cap can be repeatably threadedly attached to said disruptor container, and wherein a container cap aperture is formed through said container cap; and a strain relief connector, wherein said strain relief connector includes a strain relief connector body portion, a strain relief connector claw portion, and a strain relief connector borehole formed therethrough, wherein external strain relief connector body threads are formed within at least a portion of said strain relief connector body portion, wherein said strain relief connector body portion is formed so as to be at least partially insertable through said container cap aperture of said container cap such that at least a portion of said external strain relief connector body threads extend into said container cap recess, wherein said external strain relief connector body threads are formed so as to interact with said internal disruptor tube threads, so that said strain relief connector can be repeatably threadedly attached to said internal disruptor tube threads of said disruptor tube, wherein external connector nut threads are formed in said strain relief connector body portion, wherein said external connector nut threads are formed so as to interact with connector nut internal threads of a connector nut so that said connector nut can be threadedly attached to said strain relief connector such that interaction between said connector nut and said strain relief connector claw portion causes an inner diameter of said strain relief connector borehole, within said strain relief connector claw portion, to be reduced.

2. The explosive disruptor system of claim 1, wherein said one or more disruptor container side walls are formed of a combination of wall portions.

3. The explosive disruptor system of claim 1, wherein said one or more disruptor container side walls are formed of a single, continuous, integrally formed wall portion.

4. The explosive disruptor system of claim 1, wherein said one or more disruptor container side walls and said disruptor container bottom wall are formed of a single, continuous, integrally formed wall portion.

5. The explosive disruptor system of claim 1, wherein a longitudinal axis of said disruptor container extends generally from said disruptor container open end to said disruptor container bottom wall of said disruptor container.

6. The explosive disruptor system of claim 1, wherein said disruptor container is formed of a substantially rigid, nonmetallic and/or nonconductive material.

7. The explosive disruptor system of claim 1, wherein said disruptor container is formed of a polycarbonate, polyester, polysulfone, or polyester ketone material.

8. The explosive disruptor system of claim 1, wherein said initiating explosive chamber sidewall, said disruptor tube shoulder, and said primary explosive chamber sidewall comprise a single, continuous, integrally formed wall portion.

9. The explosive disruptor system of claim 1, wherein a size and shape of said primary explosive chamber is be formed such that a determined amount of a primary explosive material can be contained within said primary explosive chamber and a size and shape of said initiating explosive chamber is formed such that a determined amount of an initiating explosive material can be contained within said initiating explosive chamber.

10. The explosive disruptor system of claim 1, wherein a longitudinal axis of said disruptor tube extends generally from said disruptor tube open end to said disruptor tube bottom wall.

11. The explosive disruptor system of claim 1, wherein said disruptor tube is formed of a substantially rigid, non-metallic and/or nonconductive, polymer material.

12. The explosive disruptor system of claim 1, wherein said disruptor container is a 500 mL disruptor container, a length of said disruptor tube is approximately 154 mm, an outer diameter of said disruptor tube, within said initiating explosive chamber portion is approximately 20 mm, an outer diameter within said primary explosive chamber portion is approximately 13 mm, a length of said primary explosive chamber is approximately 117 mm, a length of said initiating explosive chamber is approximately 37 mm, an inner diameter of said primary explosive chamber is approximately 11 mm, an inner diameter of said initiating explosive chamber is approximately 14.25 mm, a thickness of said bottom wall is approximately 2 mm, and said thickness of said bottom wall is greater than a thickness of said primary explosive chamber sidewall.

13. The explosive disruptor system of claim 1, wherein said disruptor container is a 1000 mL disruptor container, a length of said disruptor tube is approximately 177 mm, an outer diameter of said disruptor tube, within said initiating explosive chamber portion is approximately 22 mm, an outer diameter within said primary explosive chamber portion is approximately 19 mm, a length of said primary explosive chamber is approximately 140 mm, a length of said initiating explosive chamber is approximately 37 mm, an inner diameter of said primary explosive chamber is approximately 17 mm, an inner diameter of said initiating explosive chamber is approximately 14.25 mm, a thickness of said bottom wall is approximately 2 mm, and said thickness of said bottom wall is greater than a thickness of said primary explosive chamber sidewall.

14. The explosive disruptor system of claim 1, wherein an appropriate amount of a primary explosive material is positionable within said primary explosive chamber such that said primary explosive material fills said primary explosive chamber from said disruptor tube bottom wall to said disruptor tube shoulder.

15. The explosive disruptor system of claim 1, wherein an appropriate amount of an initiating explosive material is positionable within said initiating explosive chamber such that said initiating explosive material is abutted against at least a portion of said disruptor tube shoulder.

16. The explosive disruptor system of claim 1, wherein a working fluid can be contained within said disruptor container cavity.

17. An explosive disruptor system, comprising:

a disruptor container having a disruptor container cavity formed within a portion of said disruptor container, said disruptor container cavity having one or more disruptor container side walls and a disruptor container bottom wall and extending from a disruptor container open end to a disruptor container bottom wall and having external disruptor container threads formed proximate said disruptor container open end;

a disruptor tube formed of an integral portion of material and extending from a disruptor tube open end to a disruptor tube bottom wall and including an initiating explosive chamber and a primary explosive chamber, said initiating explosive chamber being defined by an initiating explosive chamber sidewall extending from said disruptor tube open end to a disruptor tube shoulder, said primary explosive chamber being defined by a primary explosive chamber sidewall extending from said disruptor tube shoulder to said disruptor tube bottom wall, said primary explosive chamber having a reduced internal diameter when compared to an internal diameter of said initiating explosive chamber, said disruptor tube shoulder defining a transition between said initiating explosive chamber and said primary explosive chamber, and internal disruptor tube threads formed in an interior surface of a portion of said disruptor tube cavity, extending from said disruptor tube open end;

a container cap having a container cap aperture formed through said container cap; and a strain relief connector having a strain relief connector body portion and a strain relief connector claw portion, external strain relief connector body threads being formed within at least a portion of said strain relief connector body portion, said strain relief connector body portion formed so as to be at least partially insertable through said container cap aperture of said container cap such that at least a portion of said external strain relief connector body threads extend through said container cap aperture, said external strain relief connector body threads formed so as to interact with said internal disruptor tube threads, so that said strain relief connector can be repeatably threadedly attached to said internal disruptor tube threads of said disruptor tube.

18. The explosive disruptor system of claim 17, wherein said one or more disruptor container side walls are formed of a single, continuous, integrally formed wall portion.

19. The explosive disruptor system of claim 17, wherein said initiating explosive chamber sidewall, said disruptor tube shoulder, and said primary explosive chamber sidewall comprise a single, continuous, integrally formed wall portion.

20. An explosive disruptor system, comprising:

a disruptor container having a disruptor container cavity;

a disruptor tube having an initiating explosive chamber extending from a disruptor tube open end to a disruptor tube shoulder and a primary explosive chamber extending from said disruptor tube shoulder to a disruptor tube bottom wall, said primary explosive chamber having a reduced internal diameter when compared to an internal diameter of said initiating explosive chamber; a container cap having a container cap aperture formed therethrough; and a strain relief connector having a strain relief connector body portion with external strain relief connector body threads, said strain relief connector body portion being at least partially insertable through said container cap aperture such that at least a portion of said external strain relief connector body threads extend through said container cap aperture, said external strain relief connector body threads formed so as to interact with internal disruptor tube threads to repeatably threadedly attached said strain relief connector to said disruptor tube.

* * * * *